US006881110B1

(12) United States Patent
Abdel-Maksoud et al.

(10) Patent No.: US 6,881,110 B1
(45) Date of Patent: Apr. 19, 2005

(54) HIGH-SPEED VESSEL POWERED BY AT LEAST ONE WATER JET PROPULSION SYSTEM WITHOUT EXHAUST GAS TRAIL

(75) Inventors: Moustafa Abdel-Maksoud, Berlin (DE); Wolfgang Rzadki, Glinde (DE); Hannes Schulze Horn, Gladbeck (DE); Heinz Tiemens, Jork (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/377,029

(22) Filed: Mar. 3, 2003

(51) Int. Cl.[7] ..... B63H 21/32
(52) U.S. Cl. ..... 440/89 R; 60/221
(58) Field of Search ..... 440/38, 47, 89 A, 440/89 R; 60/221

(56) References Cited

U.S. PATENT DOCUMENTS

| | | | | |
|---|---|---|---|---|
| 3,134,443 A | | 5/1964 | Snow | 416/108 |
| 3,273,333 A | * | 9/1966 | Roulund | 60/221 |
| 3,970,030 A | | 7/1976 | Stangeland | 440/40 |
| 4,611,999 A | | 9/1986 | Haynes | 440/47 |
| 5,490,768 A | * | 2/1996 | Veronesi et al. | 440/38 |
| 5,679,035 A | * | 10/1997 | Jordan | 440/47 |
| 5,833,501 A | | 11/1998 | Jones | 440/1 |
| 6,024,614 A | | 2/2000 | Burg | 440/41 |
| 6,234,012 B1 | | 5/2001 | Lewis et al. | 73/118.1 |
| 6,293,836 B1 | * | 9/2001 | Blanchard | 440/47 |
| 6,616,491 B1 | * | 9/2003 | Matsuda et al. | 440/89 R |

FOREIGN PATENT DOCUMENTS

| | | |
|---|---|---|
| DE | 42 09 393 A1 | 9/1993 |
| DE | 100 08 721 A1 | 8/2001 |
| EP | 0 527 251 A1 | 2/1993 |
| EP | 0 918 014 A1 | 5/1999 |
| GB | 427393 | 4/1935 |
| GB | 1 480 381 | 7/1977 |
| GB | 2 170 664 A | 8/1986 |
| WO | WO 97/26182 | 7/1997 |

* cited by examiner

*Primary Examiner*—Lars A. Olson
(74) *Attorney, Agent, or Firm*—Harness, Dickey & Pierce, P.L.C.

(57) ABSTRACT

A propulsion system for a large watercraft, e.g., for a high-speed, military surface craft, includes at least one water jet propulsion device (water jet) beneath the vessel. An operating method of such a system includes propulsive energy by combustion engines, e.g., gas turbines, and distributing the exhaust gases created by the combustion engines beneath the vessel in the water by the use of water flow of the water jet system. In such a method, the water flow speed of the water jet system is adjusted in accordance with the requirements of exhaust gas discharge and distribution.

45 Claims, 2 Drawing Sheets

HIGH-SPEED VESSEL POWERED BY AT LEAST ONE WATER JET PROPULSION SYSTEM WITHOUT EXHAUST GAS TRAIL

FIELD OF THE INVENTION

The invention generally relates to an operating method and a propulsion system for a large watercraft, i.e., for a high-speed military surface craft that features at least one hydrojet propulsion system (water jet) beneath the vessel. Preferably it relates to one wherein combustion engines, e.g., gas turbines, produce the propulsive thrust and wherein the exhaust gases produced by the combustion engines are distributed in the water by means of the water jet system beneath the vessel.

BACKGROUND OF THE INVENTION

A propulsion system pursuant to the aforementioned description for a fast military surface craft is known from the DE 101 41 893 A1. For the familiar fast military surface craft, it is required that the vessel first be brought to cruising speed, e.g., through electric energy from fuel cells, and then the water jet propulsion system connected, wherein distribution of the exhaust gases of the combustion engines in the water is achieved by the high-powered water jet system.

SUMMARY OF THE INVENTION

It is the task of an embodiment of the invention to specify an operating method and a propulsion system for a large watercraft, even for a large civilian watercraft, e.g., a fast ferry, a large yacht or the like, where even without the use of electric energy for reaching the cruising (normal) speed, an undetectable operation without exhaust trail and free from emissions can be achieved. Thereby the propulsion efficiency should remain unimpaired and the vessel resistance lowered. This occurs through the integration of exhaust gas bubbles in the boundary layer of the hull.

The task is resolved in that the outgoing water flow speed of the water jet system is adjusted according to the specifications of the exhaust discharge and distribution.

Because the water flow speed of the water jet system is adjusted according to the specifications of exhaust gas discharge and distribution and no longer, as up to now common with water jet systems, according to the specifications of the vessel speed, it is astonishingly possible to achieve a discharge of the exhaust gases beneath the vessel even at low speeds and if need be in a stationary position. Through the exhaust gas discharge beneath the vessel even at low vessel speeds or during start-up of the vessel it is also very beneficially possible to operate vessels that do not feature electric drives at all speeds without an exhaust gas trail. Thus the locating with e.g., infrared sensors becomes significantly more difficult for Navy ships and —especially important for vessels with demanding passengers —it is achieved that no exhaust gases exist in the stern area of the vessel and likewise soot deposits from diesel engines can safely be avoided. Significant advantages thus result with the operation of vessels for Navy ships as well as for civilian vessels.

Here it is intended that the watercraft includes at least one electrically driven water jet system, wherein the electric energy is generated at least in part by generators driven by combustion engines, e.g., gas turbines. This way the propelling components can be arranged particularly conveniently in the vessel and can be utilized more effectively in the underload range. It is therefore possible to arrange the water jet system in the far front of the ship, e.g., at the beginning of the parallel hull contour. This results beneficially in the fact that the gas-water mixture produced by the water jet system flows around almost the entire hull in an anti-attrition fashion.

In one design of an embodiment of the invention it is provided that the exhaust gas discharge into the water occurs beneath the vessel without raising (compression) the exhaust gas pressure. The installation of compressors or exhaust gas ejectors for discharging the exhaust gases into the water can thus beneficially be foregone. Additionally, the efficiency of the propulsion system is no longer impaired by the energy requirements of the compressors or the ejectors.

In another design of an embodiment of the invention, it is provided that the water flow speed in the area where water exits the water jet system generates a negative pressure region with a pressure that is below the exhaust gas pressure level. This way it is beneficially possible to even increase the efficiency of the combustion engines, which is generally dependent upon the exhaust gas backpressure.

Another design of an embodiment of the invention furthermore provides that the speed of the water flow of the water jet system can be adjusted independently from the vessel speed. In conventional water jet systems, the speed of the water flow ejected from the water jet system is dependent upon the vessel speed. This could lead to the fact that the exhaust gas volume that is generated by the combustion engines will not be discharged in the underload range since the vessel is moving too slowly. The design pursuant to an embodiment of the invention prevents this.

A design of an embodiment of the invention provides that the water flow speed of the water jet system is adjusted when changing the cross-section of the water flow. This enables a particularly beneficial, simple implementation of an embodiment of the invented operating method.

The water flow speed of the water jet system can also be adjusted with a controlled change in the speed of the water flowing through the water jet system, e.g., by changing rotor speeds, but particularly beneficially by changing the velocity of water flowing through the water jet system via adjusting elements, especially via adjusting blades of the water jet system rotor whose settings can be controlled. Water jet system rotor adjusting blades whose settings can be controlled even make it possible that upon start-up of the vessel already a sufficiently fast water flow for the exhaust gas discharge is produced. Thus a start-up of the vessel without an exhaust trail is possible solely through a water jet system powered by a combustion engine, and this with high efficiency. The exhaust gas discharge into the water becomes hereby completely independent of the vessel speed, and it is possible to make vessels available without exhaust gas trails upon start-up and that are not powered by stored or generated electric energy. This is particularly important for "low cost" vessels.

The adjustment of the water flow speed of the water jet system occurs particularly favorably through a controlled change in the cross-section of the water flow, e.g., through a nozzle whose cross-section can be changed on the water flow outlet. This is a particularly simple mechanical solution. A particularly convenient operating performance occurs when the change in cross-section takes place through lead elements placed inside the water jet, e.g., axially movable pipe segments. Thus despite the lead elements a low-friction and low-turbulence design of the water jet is possible. At the same time it results in a particularly simple and sturdy mechanical solution.

In another design of an embodiment of the invention it is intended that the change in cross-section occur through lead elements arranged outside on the water jet, e.g., flaps. The flaps, which can be designed both perpendicular to the water jet formation as well as formed so as to enclose said jet as well as an iris diaphragm, can be moved simply mechanically or hydraulically. A particular advantage is that the water jet can take on a controlled adjusted cross-section that differs from a circular shape, in particular a squared or rectangular cross-section, e.g., through a corresponding outlet nozzle shape and size, which can be adapted in a hydrodynamically optimal fashion to the vessel shape (sound and vessel resistance). Thus it is possible to realize a water jet shape that is adapted to the individual vessel type, e.g., for shallow-drafting vessel a water flow in flat shape without losing the advantages of a speed of the water jet that is regulated independent of the vessel speed.

It is further intended within the scope of the invention that the water flow speed of the water jet system be adjusted between limit values that are independent of the vessel speed. Through the specification of limit values, e.g., for the minimum speed of the water jet, it can be achieved that the exhaust gases can be discharged safely in sufficient quantity, even when the vessel is only traveling slowly. The upper limit value results beneficially through a free emanation of the water flow with the highest possible water volume.

Within the scope of the invented design a propulsion device for executing the operating method for a watercraft with a water jet system that is arranged beneath the vessel is provided, wherein at the outlet of the water flow produced by the water jet an underwater exhaust gas discharge device through which the water jet system's propulsion jet flows axially is arranged, e.g., a substantially round chamber for discharging the exhaust gases into the water beneath the vessel. An embodiment of the invention can be realized beneficially in a simple manner with the provided underwater exhaust gas discharge device, in which a water jet system water flow exists that can be controlled as a function of the exhaust gas volume. Under all vessel speed conditions a safe discharge of the exhaust gases into the water and their distribution is such that the exhaust gases —finely distributed in the boundary layer —decrease the vessel's resistance.

It is provided in a design of an embodiment of the invention that the underwater exhaust gas discharge device for discharging the exhaust gases into the water be designed as a co-axial exhaust nozzle segment. An embodiment of the invention can be executed particularly beneficially through a co-axial exhaust nozzle segment, i.e., a nozzle segment, which has a co-axial design with regard to the exhaust area that surrounds the water flow of the water jet system.

It is further provided that a center element with an adjustable cross-section is placed in the underwater exhaust gas discharge device, e.g., telescoping device that effects the adjustment of the water flow speed in the underwater exhaust gas discharge device. This results in a co-axial exhaust nozzle segment with a particularly good efficiency ratio and sturdy design. Its function is such that even with a change in the water flow cross-section, no increased nozzle noise occurs. This is of particular importance for Navy ships.

In another design of an embodiment of the invention, it is provided that an exterior element with an adjustable cross-section, e.g., a controlled diaphragm, is placed in the underwater exhaust gas discharge device. The exterior element for adjusting the water flow cross-section can also be utilized in combination with the inner element and permits the cross-sectional decrease of the water jet pursuant to the invention in a simple mechanical design, e.g., in the form of a lever-actuated adjusting device.

The inner element as well as the outer element can be supplemented with the familiar water jet system deflection blades for the purpose of adjusting the water jet device or for inversion. The outlet effect pursuant to the invention for the exhaust gases is not impaired by this.

The propulsion system pursuant to an embodiment of the invention contains a pipe system for the exhaust gases in the coaxial exhaust nozzle segment, in which at least one back pressure-controlled check valve is beneficially provided. Thus, water can be prevented from moving back into the pipe system and into the combustion engines when the vessel is stopped. Apart from this check valve, the pipe system also beneficially includes a controlled shut-off device, e.g., flaps or slide valves, which act independently from the back pressure and are used by means of a propeller drive, especially in ports or while cruising.

The walls and/or blades of the water jet system beneficially contain a coating of an elastomer material. This can be hard rubber, for example, but also a fiber-reinforced polymer material. This way both cavitation effects are prevented and noise damping of the exiting water jet is also accomplished. Appropriate coatings are known from the field of centrifugal pumps, however, providing them for water jet systems is new.

Another design of an embodiment of the invention provides that the propulsion system comprises at least one, preferably retractable, rudder propeller or cycloidal propeller as the control and propulsion element of the vessel. Thus it is advantageously possible to forgo adjusting blades in the water jet system since the rudder propeller can bring the vessel to such speeds that the water jet system operates at optimal efficiency at a good ratio between intake and outlet pressure. This results without difficulty in the beneficially provided negative pressure area on the water jet outlet of the water jet system. For the purpose of operating the rudder propeller or cycloidal propeller, an embodiment of the invention provides that in the case of electric drives the propulsion system contains e.g., apart from a generator at least one additional source of electric energy such as accumulators or fuel cell systems, which allow the vessel to be run without exhaust gases. In smaller vessels the rudder propeller can also be arranged in a retractable fashion in the bow area. In this way, the common "bow thruster" can be foregone.

Furthermore, it is provided that a combustion engine comprises an exhaust gas line into the water or the atmosphere, which can be turned on optionally, for starting the watercraft.

For the purpose of controlling and regulating an embodiment of the invented operating method it is provided that sensors for pressure measurements are provided in the underwater exhaust gas inlet device for the purpose of supplying the exhaust gases to the water jet of the water jet system; similarly, sensors are provided for pressure measurements in the tail pipe system. This way, safe operation can be accomplished with simple and robust sensors.

For controlling and regulating the water jet as a function of exhaust gas intake in a beneficial design, an automation system with automation devices is provided, which relieves the operating crew of the vessel and prevents switching errors. Additionally, a coordinated control of the individual components of the drive can be accomplished by means of ramp functions.

Pursuant to an embodiment of the invention, the automation system acts not only upon the elements on the water jet system, which influence the water jet system speed and the pressure ratios, but also upon the adjusting elements and closure elements in the tail pipe system. The automation system is arranged beneficially "on location." It includes, among other things, the automation system of the combustion engine (gas turbine or Diesel engine), of the generator and the water jet system, as well as of the tail pipe system. It beneficially controls and regulates operational readiness (e.g., pressure levels and temperatures), start-up and operation (e.g., speeds and positions of control units), as well as the required electric switching and control devices (e.g., AC-AC or AC-DC regulators). In order to achieve a redundant operation, it is provided that a corresponding second automation system is located at least in part in the overall drive automation system. This results in a beneficial complete automation of the propulsion systems in relation to the water jet system as a driving component.

A design of an embodiment of the invention further provides that the heat of the exhaust gases is used via a heat exchanger system for additional operating devices, e.g., to generate warm water and/or for the desalination of seawater. This way, the energy that is required for these processes on board of the respective vessel can be advantageously reduced.

The propulsion system pursuant to an embodiment of the invention is controlled e.g., primarily based on the speed requirements of the vessel. In the case of vessels with one or more electric rudder propellers in the stern area, which at relatively low speeds provide the propulsion that is required for the desired vessel speed, the simultaneous operation of the water jet systems is also provided. This has the advantage that the vessel run resistance, which is elevated on the bottom of the vessel due to the configuration of the water jet system, can be compensated in this way. Thus, it results in no negative influence of the change in body that is required due to the water jet systems. Beneficially running of the water jet systems in vessels, which also contain, apart from the water jet systems, electric rudder propellers or a simple electric propeller drive, is provided at least from a speed of 2 to 3 knots and up. Beyond this speed it is also possible to achieve the negative pressure or null pressure required for exhaust gas intake by reducing the cross-section of the water flow of the water jet system without having to use adjusting blades in the water jet system.

For use of the invented drive device in vessels without electric rudder propellers or without conventional electric propeller drive, the adjusting blades of the water jet system rotor need no longer be set to the suction position, as is the case when starting up beyond 2 or 3 knots, but instead operation can take place in the regular propulsion position of the water jet system's rotor blades. The water jet system's adjusting blade position can thus be optimized on propulsion.

BRIEF DESCRIPTION OF THE DRAWINGS

The invention is explained in greater detail based on drawings that reveal additional ideas of the invention, as do the dependent claims. The drawings should be interpreted as supplements to FIGS. 1 and 2 of the disclosure document mentioned as the state of the art.

The drawings show in detail.

DETAILED DESCRIPTION OF THE PREFERRED EMBODIMENTS

Figure 1:
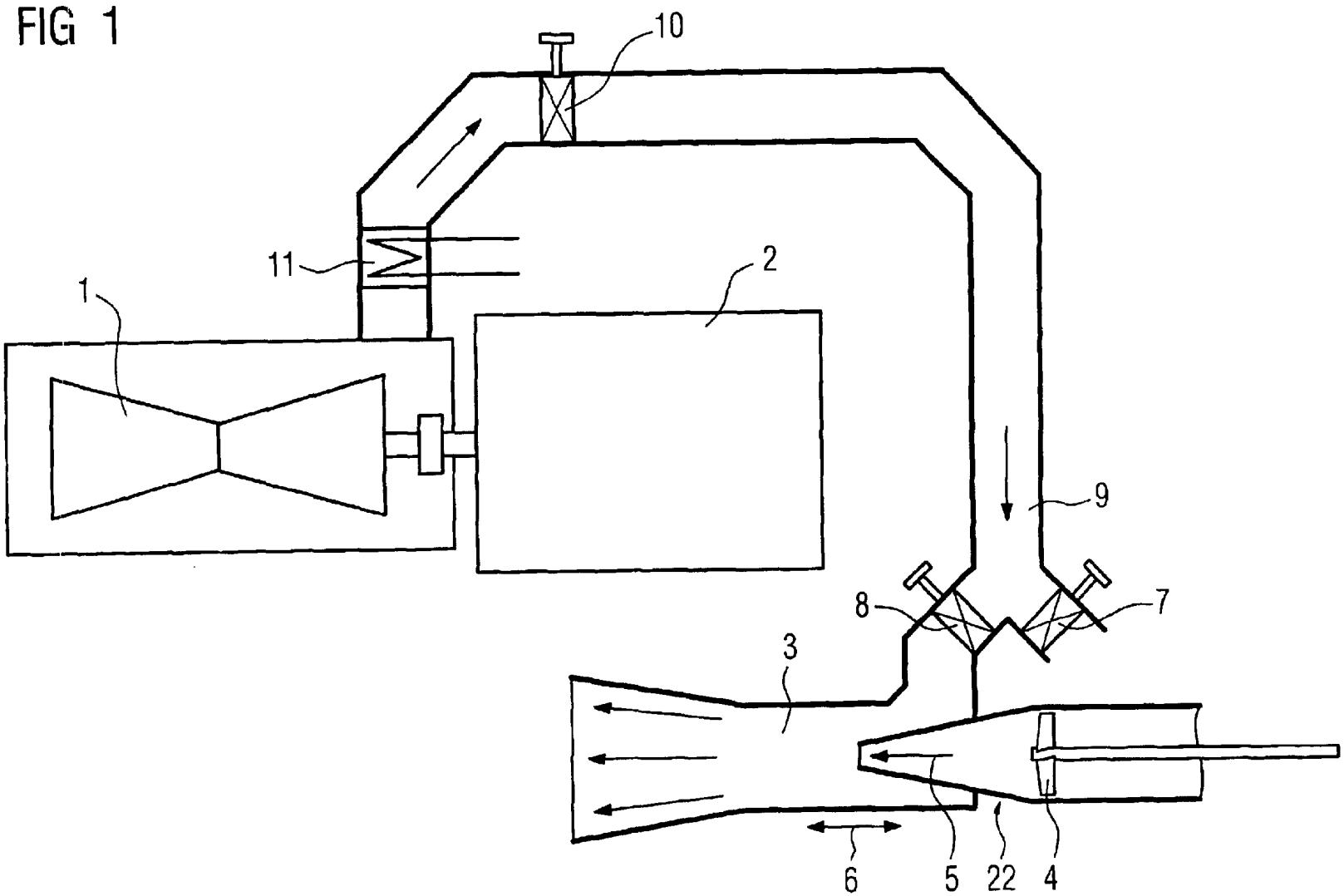
FIG. 1 the exhaust gas routing of a propulsion systems with regard to the water jet, and FIG. 2 an example of the configuration of a water jet cross-section modification element in the water jet as well as FIG. 3 a basic diagram with the input and outlet variables on the water jet.

In FIG. 1 a combustion engine, in this case a gas turbine of the type LM2500 from MTU company, is marked with reference number 1. The gas turbine drives a generator 2, here e.g., a 16 MW generator. Reference number 3 designates the coaxially operating nozzle segment, in which the diagrammatically indicated water flow or jet 5 entrains the exhaust gas that surrounds the water jet coaxially. The water jet 5 is generated by the rotor 4, which is driven e.g., by a rotor shaft. The double arrow 6 symbolizes the adjustability of the cross-section on the outlet of the water jet system so as to provide the vessel with the necessary speed even at lower driving stages in order to discharge the exhaust gas out of the chamber of the water jet outlet. In doing this, the speed of the exiting water flow can be adjusted so high with a corresponding cross-sectional decrease that even in the chamber 3 a negative pressure is created. In any case, a pressure of 0 bar can be set so that the gas turbine or a Diesel engine instead of the gas turbine does not exhibit a loss of efficiency compared to exhaust gases exiting freely into the atmosphere. The exhaust gases of the gas turbine 1 were guided to coaxially operating nozzle segments with the line 9, which when using twin water jet systems, is preferably designed in a branched fashion directly in front of the water jet systems. In the exhaust gas line 9, shut-off valves 7 and 8, which are check valves or controlled flaps, are arranged at the end in order to prevent water, which surrounds the vessel body, from flowing back into the line during a stationary position. As in the outlet area of the water flow out of the water jet system, pressure sensors can be arranged here as well that serve the purpose of regulating the exhaust gas pressure in the respective area by changing the outlet speed of the water jet system's flow or the outlet cross-section out of the line 9.

The pressure sensors can be supplemented with additional sensors, such as water intrusion alarm, valve adjustment sensors, etc. The sensor signals are sent to the automation system, which is not shown more closely and which also comprises e.g., start-up ramps for the gas turbine, for the pumps of the heat exchanger 11 and for the actuator of the main shut-off valve 10. Beyond that, the automation system comprises the usual components of a ship's propulsion system so that an autonomously operable sub-system of the ship's automation system is created. This sub-system is beneficially designed so that together with the combustion engine, the generator and the water jet system as well as the required piping it results in a ship equipment component that can be used largely unmodified for various types and sizes of vessels. Thus, it is of particular benefit if this propulsion unit is installed into the vessel in a prefabricated form when laying down the keel. The number of installed ship equipment components is hereby dependent upon the size of the vessel.

Figure 2:
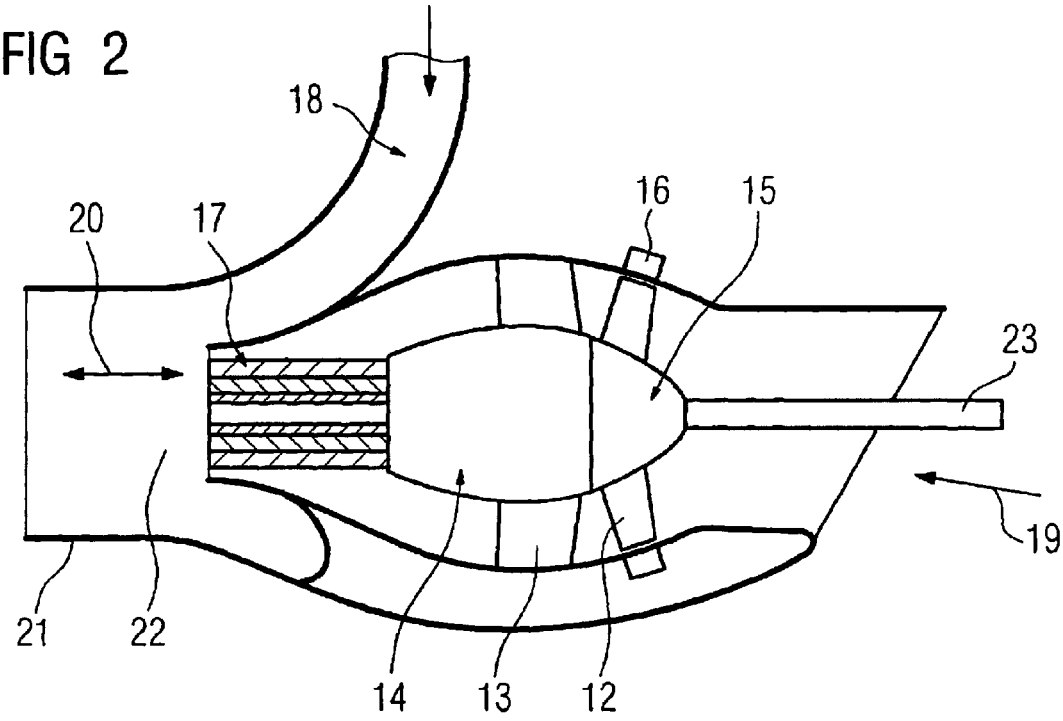

FIG. 2 describes the rotor blades, which are arranged on a rotor hub 15, with reference number 12. The rotor hub 15 can be driven in a manner that is not described in detail, e.g., with a forward engaging primary shaft 23. It can also be designed to run internally, however, wherein propulsion occurs through windings 16, which are indicated diagrammatically. Apart from a hub 14, the stator also comprises the stator blades 13, which for better starting action of the vessel if no separate propeller drive is available in the stern or the bow are also designed as adjusting blades like the rotor blades 12 and thus supplement the blade adjustment for a start-up capable water jet system.

On the outlet side, the stator hub 14 contains pipe elements 17 that can be operated hydraulically and can be telescoped to various lengths and reduce the cross-section in the annulus connector 22 so that the water speed is great enough to entrain the exhaust gases of the combustion engine that enter the annulus connector 22 via the pipe 18. The adjustability of the adjusting element 17 is indicated by the thick double arrow 20.

The annulus connector 22 is closed by walls 21 on the outside, into which e.g., annular diaphragms can be installed in order to achieve an exterior adjustment of the outlet cross-section of the water flow out of the water jet system. Such an adjustment can take place with an iris diaphragm, which contains segments in the shape of pipe sections that can be displaced from each other. A male taper, which is shifted towards the inlet side of the water, also achieves a corresponding effect. The inside contour of the male taper can correspond roughly to the contour of the outer annulus connector limit.

The inflow direction of the water is indicated with the arrow 19; it can develop both from the vessel driving through the water and from a suction effect of the water jet system that arises when the rotor and possibly the stator blades have been set appropriately. The pipe diameter, the distances in the water jet system, the blade profiles, the design of the elements that change the cross-section of the exiting flow of water are adjusted to one another and specific for each propulsion system. The propulsion systems are therefore preferably designed as autonomously operating devices, which are then assigned in different quantities, e.g., individually or as pairs, to a respective vessel type. Common to all designs is the fact that a complete discharge of the exhaust gases into the water and an even distribution of the exhaust gases beneath the vessel occur in such a way that exhaust gas bubbles that are possibly created in the water only appear behind the stern, at high driving speeds even very far behind the stern. Accordingly, there is no possibility for infrared sensors and optical sensors that are installed for detecting exhaust gases of vessels to detect the vessel that is equipped with the invented device.

Figure 3:
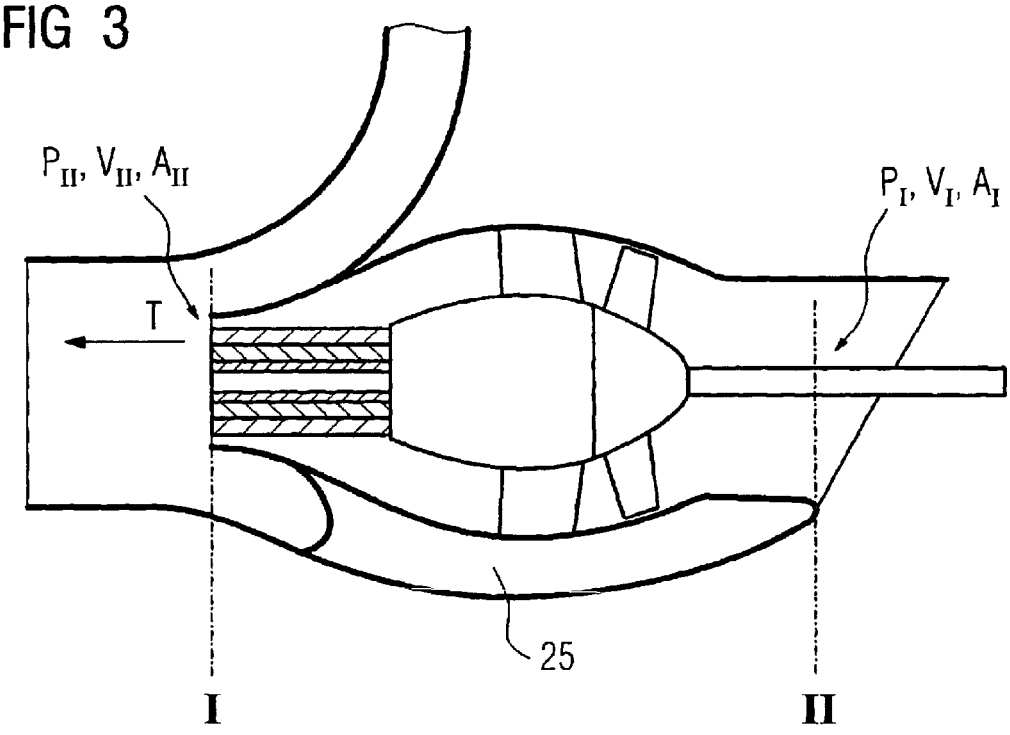

In FIG. 3 reference number 25 signifies a longitudinal section of a water jet system with the inlet plane II and the outlet plane I for the water that flows through the water jet system. The pressure and speed ratios on the water jet system can be described with the mass conservation equation and the integrated impulse equation. Beyond that, the expert can calculate the required speeds and jet cross-section in the water jet system. Application of the equations results from the calculation example, which references FIG. 3. An exemplary table depicts the important speed range pursuant to the invention. As it shows, the discharge power of the water jet system is so large that any amount of exhaust gas resulting during practical operation can be safely discharged.

| Calculation of Pressure Levels in the Outlet Plane of the Jet of the Water jet Propulsion System | |
|---|---|
| Starting Data for an Exemplary Calculation | |
| Density $\rho$ | 1.025 Kg/m$^3$ |
| Inlet Plane I | |
| Diameter $D_I$ | 1.144 m |
| Cross-Sectional Surface $A_I$ | 1.02787885 m$^2$ |
| Outlet Plane II | |
| Diameter $D_{II}$ | 0.88 m |
| Cross-Sectional Surface $A_{II}$ | 0.60821234 m$^2$ |
| Water Depth | 6 m |
| Hydrostatic Pressure | 60331.5 Pa |

Equations employed are:

1. The mass conservation equation between plane I and plane II of the water jet system $$\rho_I A_I V_I = \rho_{II} A_{II} V_{II}$$
$$\rho_I = \rho_{II} = \rho$$

2. The integrated impulse equation $$T + P_I A_{II} - P_{II} A_{II} = \rho_{II} A_{II} V_{II} V_{II} - \rho_I A_I V_I V_I$$

Wherein:

| | |
|---|---|
| $V_I$ | mean speed in the inlet plane m/s |
| $P_I$ | mean dynamic pressure portion in the inlet plane Pa |
| $V_{II}$ | mean speed in the outlet plane m/s |
| $P_{II}$ | mean dynamic pressure portion in the outlet plane Pa |
| T | thrust N that is generated |

Exemplary Calculation

| Column | Calculated Value |
|---|---|
| 1 | vessel speed in kn |
| 2 | vessel speed in m |
| 3 | mean speed in the outlet plane m/s, calculated for a fixed cross-sectional surface of the outlet, ($A_{II}$ = 0.60821234 m$^2$) |
| 4 | thrust generated for an exemplary vessel in N |
| 5 | mean dynamic pressure portion on the outlet plane in Pa |

-continued

Calculation of Pressure Levels in the Outlet Plane of the Jet of the Water jet Propulsion System

| | |
|---|---|
| 6 | mean overall pressure (hydrostatic + dynamic) on the outlet plane in Pa |
| 7 | required cross-sectional surface for a negative overall pressure in $m^2$ |
| 8 | mean speed of the outlet plane m/s |
| 9 | mean dynamic pressure portion on the outlet plane in Pa |
| 10 | mean overall pressure (hydrostatic + dynamic) on the outlet plane in Pa |
| 11 | calculated diameter of the outlet plane in m |
| 12 | calculated required reduction in the diameter of the outlet plane |
| 13 | calculated throughput quantity kg/s |

| 1 $V_I$ kn | 2 $V_I$ | 3 $V_{II}$ | 4 T | 5 $P_{II}$ | 6 $P_{II}$ Total | 7 $A_{II}$ | 8 $V_{II}$ | 9 $P_{II}$ | 10 $P_{II}$ Total | 11 $D_{II}$ | 12 Δ $D_{II}$ | 13 M |
|---|---|---|---|---|---|---|---|---|---|---|---|---|
| 30.00 | 15.43 | 26.08 | 307037.11 | 220124.90 | 280456.40 | 0.44 | 36.05 | −64209.49 | −3877.99 | 0.75 | 0.00 | 16260.17 |
| 29.00 | 14.92 | 25.21 | 280545.19 | 195231.15 | 255562.65 | 0.44 | 34.85 | −74483.69 | −14132.19 | 0.75 | 0.00 | 15718.17 |
| 28.00 | 14.40 | 24.34 | 255499.14 | 172082.00 | 232413.60 | 0.44 | 33.65 | −63125.19 | −22793.69 | 0.75 | 0.00 | 15176.16 |
| 27.00 | 13.89 | 23.47 | 231869.24 | 150628.56 | 210960.06 | 0.44 | 32.45 | −90261.56 | −29930.06 | 0.75 | 0.00 | 14634.16 |
| 26.00 | 13.38 | 22.60 | 209625.25 | 130821.15 | 191152.65 | 0.44 | 31.25 | −95941.49 | −35609.99 | 0.75 | 0.00 | 14092.15 |
| 25.00 | 12.86 | 21.74 | 188736.48 | 112609.27 | 172940.77 | 0.44 | 30.04 | −100234.79 | −39903.28 | 0.75 | 0.00 | 13550.14 |
| 24.00 | 12.35 | 20.87 | 169171.66 | 95941.54 | 156273.04 | 0.44 | 28.84 | −103212.46 | −42880.96 | 0.75 | 0.00 | 13008.14 |
| 23.00 | 11.83 | 20.00 | 105898.99 | 80765.65 | 141097.15 | 0.44 | 27.64 | −104946.81 | −44615.31 | 0.75 | 0.00 | 12466.13 |
| 22.00 | 11.32 | 19.13 | 133896.06 | 67028.32 | 127359.92 | 0.48 | 25.44 | −105511.52 | −45180.02 | 0.75 | 0.00 | 11924.13 |
| 21.00 | 10.80 | 18.26 | 118099.81 | 54675.21 | 115006.71 | 0.44 | 25.24 | −104961.69 | −44650.19 | 0.75 | 0.00 | 11382.12 |
| 20.00 | 10.29 | 17.39 | 103506.51 | 43650.95 | 103982.35 | 0.44 | 24.04 | −103433.98 | −43102.48 | 0.75 | 0.00 | 10840.12 |
| 19.00 | 9.77 | 16.52 | 90071.70 | 33898.59 | 94230.09 | 0.44 | 22.83 | −100946.71 | −40615.21 | 0.75 | 0.00 | 10298.11 |
| 18.00 | 9.26 | 15.65 | 77760.14 | 25360.46 | 85691.96 | 0.44 | 21.63 | −97600.01 | −37268.51 | 0.75 | 0.00 | 9756.10 |
| 17.00 | 8.75 | 14.78 | 66535.71 | 17977.1 | 78308.6 | 0.44 | 20.43 | −93475.93 | −33144.43 | 0.75 | 0.00 | 9214.10 |
| 16.00 | 8.23 | 13.91 | 56361.39 | 11667.66 | 72019.16 | 0.44 | 19.23 | −88658.59 | −28327.09 | 0.75 | 0.00 | 8672.09 |
| 15.00 | 7.72 | 13.04 | 47199.16 | 6429.89 | 66761.05 | 0.44 | 18.03 | −83234.45 | −22902.95 | 0.75 | 0.00 | 8130.09 |
| 14.00 | 7.20 | 12.17 | 39009.88 | 2138.66 | 62470.05 | 0.44 | 16.83 | −77292.45 | −16960.95 | 0.75 | 0.00 | 7588.08 |
| 13.00 | 6.69 | 11.30 | 31753.19 | −1251.82 | 59079.69 | 0.44 | 15.62 | −70924.30 | −10592.90 | 0.75 | 0.00 | 7046.07 |
| 12.00 | 6.17 | 10.43 | 25387.38 | −3810.07 | 56521.43 | 0.44 | 14.42 | −64224.80 | −3893.30 | 0.75 | 0.00 | 6504.07 |
| 11.00 | 3.66 | 9.56 | 19869.21 | −5607.38 | 54724.18 | 0.4 | 14.54 | −82725.52 | −22394.02 | 0.71 | 0.03 | 5962.06 |
| 10.00 | 5.14 | 8.69 | 15153.74 | −6717.66 | 53614.04 | 0.4 | 19.22 | −71535.94 | −11204.44 | 0.71 | 0.03 | 5420.06 |
| 9.00 | 4.63 | 7.82 | 11194.02 | −7217.67 | 53113.63 | 0.4 | 11.90 | −60645.38 | −313.88 | 0.71 | 0.03 | 4878.05 |
| 8.00 | 4.12 | 6.96 | 7940.83 | −7188.90 | 53142.60 | 0.25 | 16.92 | −190339.44 | −130007.94 | 0.56 | 0.18 | 4336.05 |
| 7.00 | 3.60 | 6.09 | 5342.18 | −6716.90 | 53614.91 | 0.25 | 14.81 | −148678.68 | −88347.18 | 0.56 | 0.18 | 3794.04 |
| 6.00 | 3.09 | 5.22 | 3342.81 | −5891.63 | 54439.87 | 0.25 | 12.69 | −111561.54 | −51230.06 | 0.56 | 0.18 | 3252.03 |
| 5.00 | 2.57 | 4.35 | 1883.23 | −4811.73 | 55518.77 | 0.25 | 10.58 | −79225.72 | −18894.22 | 0.56 | 0.18 | 2710.03 |
| 4.00 | 2.06 | 3.48 | 898.77 | −3583.50 | 56748.00 | 0.1 | 21.15 | −404967.35 | −344635.89 | 0.36 | 0.39 | 2168.02 |
| 3.00 | 1.54 | 2.61 | 316.85 | −2325.99 | 58005.61 | 0.1 | 15.86 | −229681.29 | −169349.79 | 0.36 | 0.39 | 1626.02 |
| 2.00 | 1.03 | 1.74 | 53.31 | −1177.66 | 59153.84 | 0.1 | 10.58 | −102955.72 | −42624.22 | 0.36 | 0.39 | 1084.01 |
| 1.00 | 0.51 | 0.87 | 0.00 | −316.33 | 60015.17 | 0.1 | 5.29 | −25872.20 | −34459.30 | 0.36 | 0.39 | 542.01 |

Column 10 shows that after 2 knots negative pressures occur in the outlet plane of the drive. The calculated throughput quantities in column 13 are considerably higher than the minimum required throughput quantity for transporting the exhaust gases.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An operating method for a propulsion system of a large watercraft including at least one water jet propulsion system located beneath the watercraft, the method comprising:

generating propulsive energy by at least one combustion engine;

distributing exhaust gases, created by the at least one combustion engine, beneath the watercraft in the water by using water flow of the at least one water jet propulsion system; and adjusting speed of the water flow of the at least one water jet propulsion system in accordance with requirements of exhaust gas discharge and distribution.

2. The operating method of claim 1, wherein the watercraft includes at least one water jet propulsion system driven by electric energy, wherein the electric energy is generated at least in part by at least one generator driven by the at least one combustion engine.

3. The operating method of claim 1, wherein the exhaust gas discharge into the water beneath the watercraft occurs without raising the exhaust gas pressure.

4. The operating method of claim 1, wherein the water flow speed creates a negative pressure area on an outlet of the water flow out of the water jet propulsion system at a pressure that is below the exhaust gas pressure.

5. The operating method of claim 1, wherein the speed of the water flow of the water jet propulsion system is adjusted independent from the watercraft speed.

6. The operating method of claim 1, wherein the speed of the water flow of the water jet propulsion system is adjusted by changing the cross-section of the water flow.

7. The operating method of claim 1, wherein the speed of the water flow of the water jet propulsion system is adjusted through a controlled change in the water flow speed through the water jet propulsion system.

8. The operating method of claim 1, wherein the change in water flow speed through the water jet propulsion system occurs with adjusting elements.

9. The operating method of claim 1, wherein the water flow speed of the water jet propulsion system is adjusted through a change in the cross-section of the water flow.

10. The operating method of claim 9, wherein the change in cross-section occurs with lead elements, arranged in the interior of the water jet.

11. The operating method of claim 9 wherein the change in cross-section occurs with lead elements arranged on the outside of the water jet.

12. The operating method of claim 1, wherein the water flow is given a controlled adjustable cross-section that differs from a circular shape through a corresponding outlet nozzle shape and size.

13. The operating method of claim 1, wherein the water flow speed of the water jet propulsion system is adjusted between limit values that are independent from the watercraft speed.

14. A propulsion system for conducting the operating method of claim 1, for a watercraft including a water jet propulsion system that is arranged beneath the watercraft, comprising:

an underwater exhaust gas discharge device through which the water jet system's water flows axially, arranged on the outlet of the water flow generated by the water jet propulsion system for discharging the exhaust gases into the water beneath the watercraft.

15. The propulsion system of claim 14, wherein the chamber for discharging the exhaust gases into the water is designed as a coaxial exhaust nozzle segment.

16. The propulsion system of claim 14, wherein the chamber includes a center element with an adjustable cross-section, adapted to affect the adjustment of the water flow speed in the chamber.

17. The propulsion system of claim 14, wherein in the chamber includes an exterior element including a cross-section adapted to be changed.

18. The propulsion system of claim 14, wherein the propulsion system includes pipe system, which guides the exhaust gases into the a coaxial exhaust nozzle segment, the pipe system including a check valve controlled by back-pressure.

19. The propulsion system of claim 14, wherein at least one of the walls and blades of the water jet propulsion system contain a coating made of at least one of elastomer material and fiber-reinforced polymer.

20. The propulsion system of claim 14, including at least one of a retractable rudder propeller and a cycloidal propeller as a control and propulsion device of the watercraft.

21. The propulsion system of claim 14, wherein apart from at least one generator, at least one additional source of energy is available for enabling emission-free movement of the watercraft.

22. The propulsion system of claim 14, wherein, a combustion engine for starting the watercraft contains an optionally activated exhaust gas line into at least one of the water and the atmosphere.

23. The propulsion system of claim 14, wherein, in the underwater exhaust gas discharge device of the water jet propulsion system sensors for pressure measurements are arranged.

24. The propulsion system of claim 14, wherein in an exhaust gas pipe system of the propulsion system, sensors for pressure measurements are arranged.

25. The propulsion system of claim 14, further comprising:

an automation device, adapted to control the water jet cross-section as a function of the pressure conditions in the underwater exhaust gas discharge device.

26. The propulsion system of claim 14, further comprising:

an automation device, adapted to control adjusting elements at least one of on and in the water jet propulsion system, as a function of the pressure conditions in the underwater exhaust gas discharge device.

27. The propulsion system of claim 14, further comprising:

an automation device for controlling valves in a tail pipe system.

28. The propulsion system of claim 14, wherein the heat of the exhaust gases is used via a heat exchanger system for other operating devices.

29. The operating method of claim 1, wherein the watercraft is a high-speed, military surface craft.

30. The operating method of claim 1, wherein the at least one combustion engine is a gas turbine.

31. The operating method of claim 1, wherein the change in water flow speed through the water jet propulsion system occurs with controlled adjustable adjusting blades of the water jet system's rotor.

32. The operating method of claim 1, wherein the water flow speed of the water jet propulsion system is adjusted by use of a nozzle on the water flow outlet that is adjustable in its cross-section, on the water jet propulsion system.

33. The operating method of claim 9, wherein the change in cross-section occurs with axially displaceable pipe sections arranged in the interior of the water jet.

34. The operating method of claim 10, wherein the change in cross-section occurs with lead elements arranged on the outside of the water jet.

35. The operating method of claim 9, wherein the change in cross-section occurs with flaps arranged on the outside of the water jet.

36. The operating method of claim 10, wherein the change in cross-section occurs with flaps arranged on the outside of the water jet.

37. The operating method of claim 1, wherein the water flow is given a controlled adjustable at least one of square and rectangular cross-section through a corresponding outlet nozzle shape and size.

38. The propulsion system of claim 14, wherein the underwater exhaust gas discharge device includes a substantially round chamber.

39. The propulsion system of claim 14, wherein the chamber includes a telescoping device with an adjustable cross-section to affect the adjustment of the water flow speed in the chamber.

40. The propulsion system of claim 14, wherein the chamber includes an adjustable diaphragm, including a cross-section adapted to be changed.

41. The propulsion system of claim 14, wherein, apart from at least one generator, at least one of an accumulator and a fuel cell system is available for enabling emission-free movement of the watercraft.

42. The propulsion system of claim 14, further comprising:

an automation device, adapted to control adjusting of blades in the water jet propulsion system, as a function of the pressure conditions in the underwater exhaust gas discharge device.

43. The propulsion system of claim 14, wherein the heat of the exhaust gases is used via a heat exchanger system for at least one of generating warm water and seawater desalination purposes.

44. A propulsion system of a watercraft, comprising:

at least one combustion engine, adapted to generate propulsive energy;

means for distributing exhaust gases, created by the at least one combustion engine, beneath the watercraft in the water by using water flow of the system; and means for adjusting speed of the water flow of the system in accordance with requirements of exhaust gas discharge and distribution.

45. The propulsion system of claim 44, wherein the means for distributing includes an underwater exhaust gas discharge device, through which the system water flows axially, arranged on the outlet of the water flow generated by the system, for discharging the exhaust gases into the water beneath the watercraft.

* * * * *